US005485939A

United States Patent [19]

Tucker

[11] Patent Number: 5,485,939

[45] Date of Patent: Jan. 23, 1996

[54] LOLLIPOP DISPENSER APPARATUS

[76] Inventor: Gary D. Tucker, 304 Otis St., Lakewood, Colo. 80226

[21] Appl. No.: 336,836

[22] Filed: Nov. 9, 1994

[51] Int. Cl.[6] ..... G07F 11/00

[52] U.S. Cl. ..... 221/86; 221/120; 221/194

[58] Field of Search ..... 221/2, 3, 7, 9, 221/86, 76, 82, 289, 194, 120, 121, 155

[56] References Cited

U.S. PATENT DOCUMENTS

| | | | |
|---|---|---|---|
| 3,104,028 | 9/1963 | Brown | 221/86 |
| 4,284,206 | 8/1981 | Wittern | 221/90 |
| 4,876,532 | 10/1989 | Sauls | 221/3 |

*Primary Examiner*—Kenneth Noland
*Attorney, Agent, or Firm*—Phillip A. Rein

[57] ABSTRACT

A lollipop dispenser apparatus having a main support housing assembly with a dispenser housing assembly mounted thereon, both constructed of a transparent material for customer appeal. A product support and dispensing assembly has a product support and display assembly within the dispenser housing assembly and a product dispensing assembly within the main support housing assembly and interconnected to each other. The product support and display assembly has a plurality of product support and anchor assemblies operable to have various vertically spaced dispensing levels, each having a plurality of lollipop members supported by an outer end of respective lollipop support sticks and presented in a radial wheel fashion. The product dispensing assembly includes a plurality of spaced motor drive assemblies, each connected to a respective gear drive assembly to selectively rotate the product support and anchor assembly to dispense a lollipop member therefrom under the force of gravity. A product accounting and control assembly includes a product trip lever assembly operable, on receiving a lollipop member thereagainst, to actuate a product actuator switch assembly which then de-energizes an entire electrical control circuit to cease power drain on a power source being rechargeable battery members. A timer circuit controls actuation of a drive motor member so that, if a lollipop is not present on the product support and anchor assembly, then the user can select another dispensing level so that a lollipop member is always dispensed.

26 Claims, 7 Drawing Sheets

LOLLIPOP DISPENSER APPARATUS

PRIOR ART

A patent search was conducted on this invention and revealed the following United States patents:

| U.S. Pat. No. | Inventor |
|---|---|
| 830,815 | Ziebell |
| 1,743,092 | Bereck |
| 1,842,243 | Boyer |
| 2,208,298 | Mahaffey |
| 3,104,028 | Brown |
| 3,709,404 | Dana |
| 4,159,612 | Johnson et al |
| 4,284,206 | Wittern |
| 5,152,422 | Springer |
| 5,253,782 | Gates et al |

Each of the patents disclose a carousel-type dispensing machine designed to dispense products one at a time from a plurality of magazines arranged in a carousel configuration.

The most pertinent reference is the patent to Brown No. 3,104,028 which discloses a stacked array of carousel trays or drums 30–33 (FIG. 10) each carrying a product. Each drum can carry a different product, thus providing for a selection from a variety of products. The drums can be separately driven by a motor and chain in order to dispense a selected one of the different variety of articles.

The patent to Wittern, No. 4,284,206, discloses a carousel-type apparatus for dispensing articles supported on plates, each being of a pie section shape. Note the electrical control circuits shown in FIGS. 12 and 14.

The Ziebell Pat. No. 830,815 discloses a carousel for dispensing pencils singularly through a hole 34. However, the pencils are held in a vertical position rather than a horizontal position.

The vending machines shown in the patents to Boyer, No. 1,842,243, and Mahaffey, No. 2,208,298, allow the customer to manually select the column or magazine containing the desired product and then, upon the deposit of a coin, the product is released from the bottom of the magazine. The vending apparatus shown in the patent to Mahaffey, No. 2,208,298, holds each product in a vertical array on the exterior of a cylinder with a clamp being released to release the product to be dispensed.

In the patent to Dana, No. 3,709,404, a carousel is rotated by a motor with an electrical control circuit shown in FIG. 12.

The patent to Johnson, et al., Pat. No. 4,159,612, discloses an apparatus for producing lollipops by forming a body of candy and inserting a stick into the candy. The lollipops are held by their sticks, and each stick is held between a plunger and the wall of a recess into which the stick is inserted (see FIG. 10).

While the references show control circuits for the dispensing devices such as Dana, Pat. No. 3,709,404 and Wittern, Pat. No. 4,284,206, neither one shows a timer-controlled coin loss preventive circuit. Time-controlled circuits, coin holding circuits, and the like are known for other applications.

PREFERRED EMBODIMENT OF THE INVENTION

In one preferred embodiment of this invention, a lollipop dispenser apparatus is operable to receive, enclose, and selectively dispense individual lollipop members therefrom. Each lollipop member is held in a horizontal position and being supported by an outer end of a support stick connected to a circular wrapped food product. The supported lollipop members are held in a plurality of parallel, vertically stacked planes and selectively dispensed one at a time on insertion of a coin or coins into a coin acceptor assembly which is a part of the lollipop dispenser apparatus.

The lollipop dispenser apparatus includes 1) a main support housing assembly; 2) a dispenser housing assembly mounted on a top surface of the main support housing assembly; 3) a product support and dispensing assembly mounted within the main support housing assembly and the dispenser housing assembly; 4) a product accounting and control assembly operable to receive released lollipop members from a product support and display assembly in the product support and dispensing assembly; 5) a coin acceptor, selector, and dispenser assembly mounted in the main support housing assembly operable to selectively dispense a lollipop member on receiving a proper amount of a coin or multiple coins; and 6) an electrical control circuit mounted within the main support housing assembly to control a unique dispensing of the lollipop members.

The main support housing assembly is of generally rectangular box shape, preferably constructed of a transparent material, and having an intermediate wall member to divide a portion of the interior thereof wherein a lower portion is operable to enclose battery members and a coin receiver tray member.

The dispenser housing assembly is preferably constructed of a transparent material so that the lollipop members are prominently displayed therein in an adjacent, wheel spoke manner before a selective dispensing operation.

The dispensing housing assembly is preferably of an octangular shape having a plurality, namely eight, side wall sections secured at upper edges to a top wall member having a shaft opening therein. The dispenser housing assembly is releasably connected to the main support housing assembly so that the lollipop members contained therein can be replenished as required due to sales thereof.

The product support and dispensing assembly includes a product support and display assembly mounted within the dispenser housing assembly and connected to a product dispensing assembly mounted within the main support housing assembly. The product support and display assembly includes a support shaft assembly having connected thereto a product support and anchor assembly.

The support shaft assembly includes a central primary support shaft having telescopingly mounted thereabout a first dispensing shaft member; a second dispensing shaft member; a third dispensing shaft member; a fourth dispensing shaft member; a fifth dispensing shaft member; and a sixth dispensing shaft member.

The product support and anchor assembly includes a plurality of spaced product support assemblies with each operable to receive and selectively rotate a plurality of lollipop members connected thereto.

Each of the dispensing shaft members are operable to support and rotate a portion of a respective product support assembly connected thereto and operable to support a plurality of lollipop members at an outer end of their respective support sticks. It is noted that we have a total of six dispensing shaft members, thereby providing six parallel, vertically spaced layers of lollipop members to be selectively dispensed therefrom. It is obvious that any number of dispensing shaft members can be utilized, such as up to ten or twelve, and only would require the addition of extra product support assemblies, power motor members, and increased height of the dispenser housing assembly.

Each product support assembly includes 1) a stationary support member; 2) a rotatable support member mounted in cooperating adjacent relationship with the stationary support member; 3) a connector cylinder member connected to adjacent ones of the respective stationary support members and a portion of the main support housing assembly; and 4) a plurality of bearing members which are mounted between the stationary support member and the rotatable support member to decrease friction on rotation of the rotatable support member having the lollipop member connected thereto.

Respective ones of the rotatable support members are connected to one of the first, second, third, fourth, fifth, and sixth dispensing shaft members so as to be rotatable therewith for selective dispensing of a desired lollipop member therefrom.

Each rotatable support member has a cylindrical dispensing plate member having a plurality of product containment slots, each operable to receive an outer end of a support stick of a lollipop member for display and subsequent rotation in a respective horizontal plane.

The product dispensing assembly includes a plurality of motor drive assemblies, each associated with a gear drive assembly. Each motor drive assembly includes a drive motor member connected to a drive gear member and connected to a respective one of the first, second, third, fourth, fifth, and sixth dispensing shaft members for selective rotation of a selected one of the product support and anchor assemblies for selective rotation.

The gear drive assemblies are mounted in a stacked relationship on the support shaft assembly so as to have clearance for rotation of the interconnection to respective ones of the gear drive members. Each motor member is connected to a motor support member which, in turn, is connected to a motor support shaft which, in turn, is anchored to the main support housing assembly.

The gear drive assembly includes a plurality, namely six, of driven gear members which are mounted on respective ones of the first, second, third, fourth, fifth, and sixth dispensing shaft members. The driven gear members are rotated by respective ones of the drive motor members to cause respective rotation of the dispensing shaft members and the rotatable support members connected thereto.

The product accounting and control assembly includes 1) a product trip lever assembly operable to receive a lollipop member being dispensed thereagainst for controlled dispensing and accounting purposes; 2) a product actuator switch assembly engaged by the product trip lever assembly for de-energization of the entire electrical circuit so that the lollipop dispenser apparatus returns to a ready-to-vend state; 3) a dispenser control assembly operable to control access to a dispensed lollipop member; and 4) a dispenser director housing assembly to receive the dispensed lollipop members therein.

The product trip lever assembly includes a trip lever member pivotally connected on a support shaft member and having a counterbalanced member connected thereto. The trip lever member has a product contact plate normally held in a horizontal position below a product dispensing opening by the counterbalance member.

On receiving a dispensed lollipop member against the product contact plate, the weight of the lollipop member causes a pivotal movement thereof which causes a mechanical contact against a product actuator switch assembly. Pivotal movement of the product contact plate occurs when the product, namely the lollipop member has been dispensed and, on opening of an electrical circuit through the product actuator switch assembly, all power supply is then de-energized to cease any electrical drain on the battery members and reset the lollipop dispenser apparatus so that another vend may occur.

The dispenser control assembly includes a product speed control member which is pivoted on contact by the weight of the lollipop member to allow the lollipop member to be directed into the dispenser director housing assembly.

The access control member is pivotable about an access shaft member in one direction which allows the lollipop member to enter into a position adjacent a front wall member of the main support housing assembly.

The dispenser control assembly is operable 1) to receive the dispensed lollipop member therein so that it can be removed therefrom by a person operating the lollipop dispenser apparatus; and 2) prevents the person receiving the lollipop member from reaching inwardly into the operating mechanism of the lollipop dispenser apparatus.

The coin acceptor, selector, and dispenser assembly includes 1) a coin acceptor assembly mounted on the front wall member of the main support housing assembly; 2) a dispenser selector switch connected to a top wall member of the main support housing assembly; 3) a coin acceptor light member; 4) a product dispensing light member; and 5) a coin receiver switch member with above items 2)–4) all mounted in adjacent relationship on a front portion of the top wall member of the main support housing assembly.

The coin acceptor assembly is known in the prior art and can be set to accept single or multiple coin members therein, such as a quarter or two dimes and a nickel, if that is the predetermined amount selected for the cost of a single lollipop member.

The coin acceptor assembly includes 1) a coin deposit slot; 2) a coin reject button; 3) a coin return slot; 4) a coin return cup to receive a returned coin therein; and 5) a coin receiver switch mounted therein.

The coin receiver switch is a micro switch and operates to send a signal or electrical impulse to the electrical control circuit that the proper coin or combination of coins have been received therein. This signal energizes the electrical system to start electrical current flowing therein to achieve the dispensing of a lollipop member therefrom.

The dispenser selector switch is a conventional rotatable switch having a control knob with a selector line thereon which is selectively aligned with adjacent product selector indicia. The product selector indicia are numbers indicating the particular horizontal layer of lollipop members from which the operator wishes to obtain. In this case, the product selector indicia is numbered from one to six, inclusive, which will conform to similar numbered indicia on a front top side wall section of the dispenser housing assembly.

The electrical control circuit includes a pair of 4½ volt battery members providing a 9 volt operation of the lollipop dispenser apparatus. Alternatively, one or several 9 volt radio batteries connected in parallel could be utilized as a power source.

The electrical control circuit operates under the following steps being 1) to energize the other elements of the system on the proper number of coins received in the coin acceptor assembly which then trips the coin receiver switch which triggers a silicon controlled rectifier that energizes the coin acceptor light member which will be a flashing red light and provides electrical power to the rest of the electrical control circuit; 2) the operator will then rotate the dispenser selector switch to align the selector line on the control knob to a desired one of the product selector indicia; 3) the operator would then depress the dispenser selector switch or button member which would then concurrently energize the dispensing light member which is normally a flashing green light and energize a timing circuit; 4) actuation of the dispenser button member would operate through the dispenser selector switch to energize a respective one of the drive motor members and rotate a selected one of the rotatable support members of the product support assembly which would permit a lollipop member on a selected one of the six horizontal layers to fall through an opening in an adjacent stationary support member so that the lollipop member is being dispensed under the force of gravity towards the product trip lever assembly; and 5) movement of the trip lever assembly would actuate the product actuator switch assembly which would then de-energize the entire electrical control circuit so as not to have a power drain on the battery members and return the lollipop dispenser apparatus to a ready-to-vend state.

After the last step 5), the lollipop dispenser apparatus can be utilized to repeat the aforementioned steps on insertion of a coin or coins into the coin acceptor assembly.

The electrical control circuit includes the timing circuit to rotate a selected respective one of the rotatable support members of the product support assemblies for an adjustable time period or until a lollipop member has been dispensed.

If a certain horizontal layer of the product support and anchor assembly has been exhausted of lollipop members after a timed rotation, the red flashing coin acceptor light member would continue to flash. After the timed rotation of the empty rotatable support member, the user can then select another layer of supported horizontal lollipop members by rotation of the dispenser selector switch. The dispenser button member would be depressed and this will then cause rotation of a selected one of the rotatable support members until a lollipop member is dispensed to actuate the product trip lever assembly. This trips the product actuator switch assembly which will then de-energize the flashing green and red lights, the electrical control circuit, and cease any electrical drain from the battery members.

The electrical control circuit is provided with a tilt siren assembly which is known in the prior art having a pivotal mercury switch or like tilt mechanism therein to set off an alarm when the lollipop dispenser apparatus is being impacted or experiencing unauthorized movement.

OBJECTS OF THE INVENTION

One object of this invention is to provide a lollipop dispenser apparatus operable to receive and support horizontal layers of a plurality of lollipop members being adjacent and extended in a radial direction plus having a dispenser housing assembly mounted on a support housing assembly and being constructed of a transparent material permitting observance of the lollipop members, drive motor members and gear members, and other elements for customer appeal.

Another object of this invention is to provide a lollipop dispenser apparatus operable to receive a coin therein to energize a product support and dispensing assembly for dispensing of a lollipop member therefrom and having electrical means operable by battery members with an electrical control circuit not energized until a coin is placed therein and de-energized after a positive dispensing of a lollipop member therefrom so that power drain on the battery members only occurs after coin acceptance and power drain is ceased on the lollipop member being dispensed therefrom. The use of battery members permits placement of the lollipop dispenser apparatus without regard to availability of electrical outlets.

One other object of this invention is to provide a lollipop dispenser apparatus having a plurality of horizontally stacked product support and anchor assemblies, each operable to receive and support an outer end of a support stick on the lollipop member to achieve a colorful and attractive product display.

One other object of this invention is to provide a lollipop dispenser apparatus having an electrical control circuit therein in order to 1) indicate by a flashing light that the system is energized and an actuator coin has been accepted; 2) operate a dispenser selector switch or an array of push button switches that correspond to each layer of adjacent lollipop members for the user to select a desired lollipop member to be dispensed; 3) depress a product dispenser button member which energizes a flashing product dispensing light member and a product support and dispensing assembly; 4) rotate a respective drive motor member to rotate a selected one of a rotatable support member; and 5) dispense a lollipop member under the force of gravity which actuates a product actuator switch which then de-energizes the entire system to cease electrical power drain on battery members.

Another object of this invention is to provide a lollipop dispenser apparatus having a product dispensing accounting means so that, after a coin or coins have been accepted and so indicated by a flashing light, if a malfunction occurs due to lack of lollipop members and a lollipop member is not dispensed, the system remains actuated and energized so that the user can select a different layer of supported lollipop members to dispense therefrom thus achieving a fail-safe system so that the users always receive the product therefrom and will not have an inclination to inflict damage to the lollipop dispenser apparatus.

Still, one other object of this invention is to provide a lollipop dispenser apparatus which is attractive in appearance; allows observance of the internal structure and operation thereof; operable to receive and support a large amount of supported lollipop members in a wheeled spoked type appearance; sturdy in construction; easy to load and unload food product or lollipop members therein; and substantially maintenance free. Various other objects, advantages, and features of the invention will become apparent to those skilled in the art from the following discussion, taken in conjunction with the accompanying drawings, in which:

FIGURES OF THE INVENTION

Figure 8:
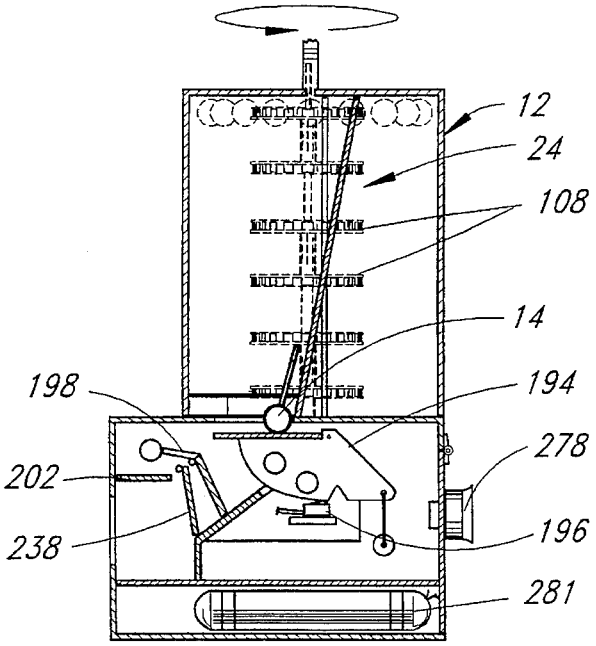
Figure 9:
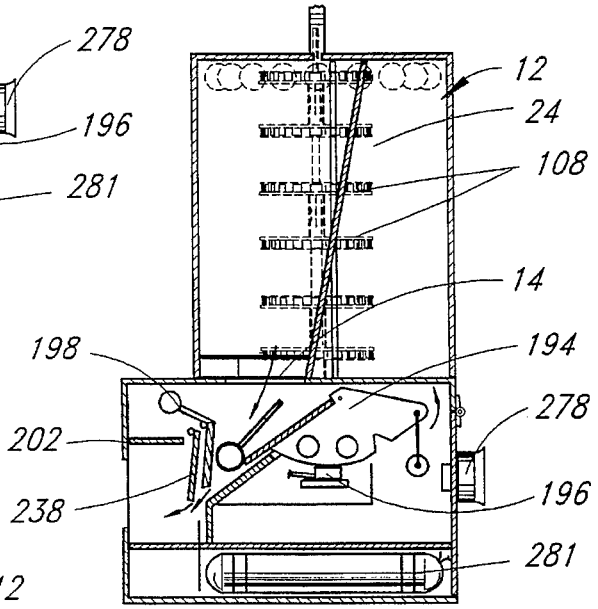
Figure 10:
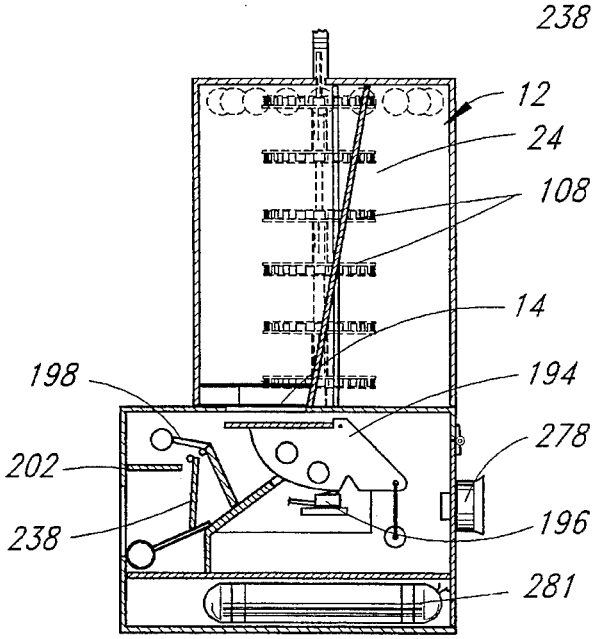

FIGS. 8, 9, and 10 are schematic diagrams illustrating the use and operation of the lollipop dispenser apparatus of this invention on dispensing a lollipop member therefrom.

The following is a discussion and description of preferred specific embodiments of the lollipop dispenser apparatus of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Figure 1:
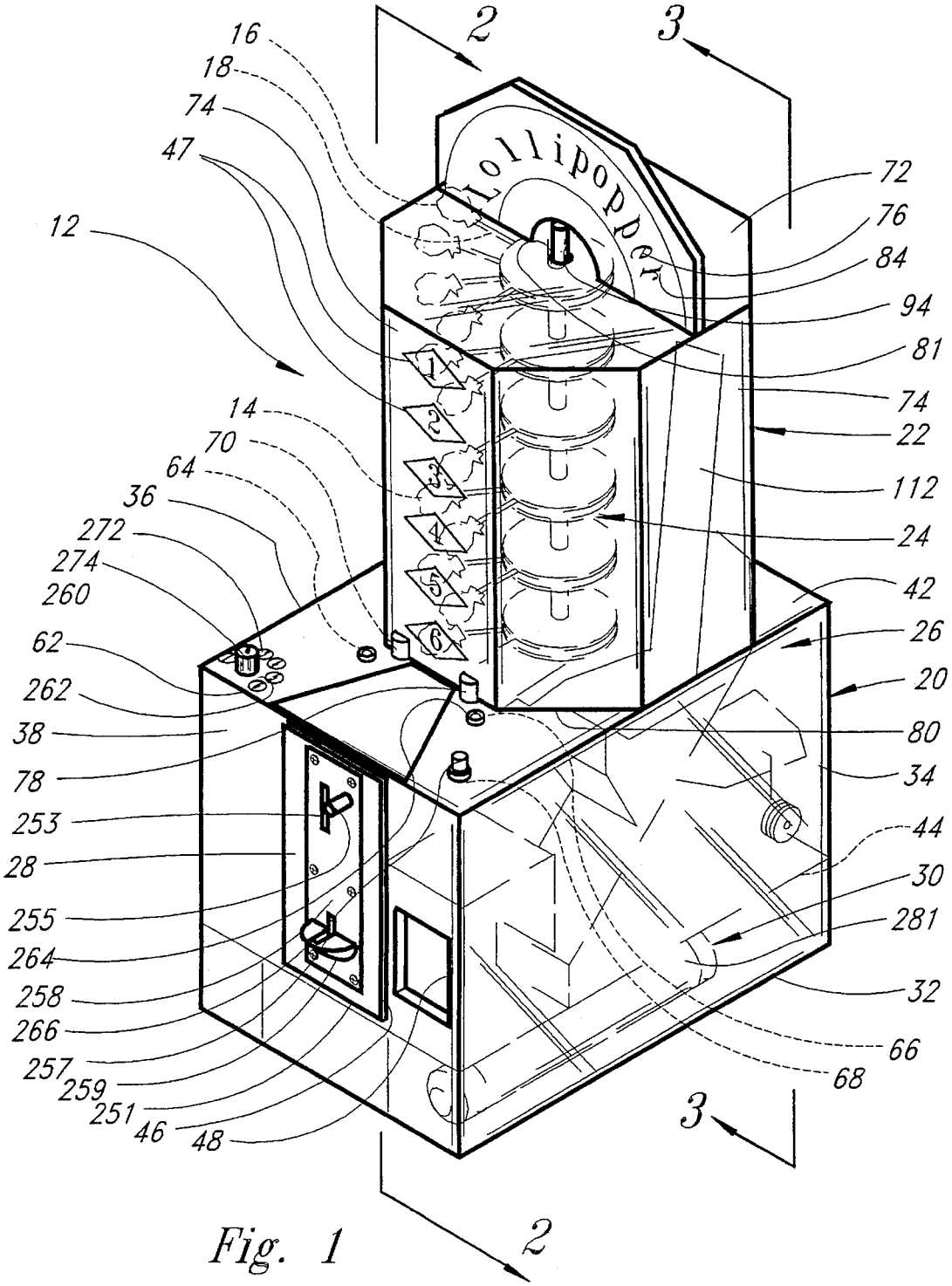
FIG. 1 is a perspective view of a lollipop dispenser apparatus of this invention.

On referring to the drawings in detail, and in particular to FIG. 1, a lollipop dispenser apparatus of this invention, indicated generally at 12, is shown constructed of a transparent material and having mounted therein a plurality of spaced lollipop members 14 being held in separate, vertically spaced, horizontal dispensing rows. The lollipop members 14 are each supported by an outer end of a support stick 18 having a food product 16 mounted on an opposite outer end thereof comprising a respective lollipop members 14.

The lollipop dispenser apparatus 12 includes 1) a main support housing assembly 20; 2) a dispenser housing assembly 22 mounted on the main support housing assembly 20; 3) a product support and dispensing assembly 24 having a portion mounted within the main support housing assembly 20 and interconnected to a second portion mounted within the dispenser housing assembly 22; 4) a product accounting and control assembly 26 mounted within the main support housing assembly 20 for controlled dispensing of the lollipop members 14; 5) a coin acceptor, selector, and dispenser assembly 28 mounted on and within the main support housing assembly 20 and operably connected to the product support and dispensing assembly 24; and 6) an electrical control circuit 30 operable to monitor coin acceptance, selection of a lollipop member 14 to be dispensed, a safety system to assure that, on a coin insertion operation, a lollipop member 14 is dispensed, plus a system to assure that the dispensing operation has been completed.

As noted in FIG. 1, the main support housing assembly 20 includes a bottom wall member 32 connected to spaced side wall members 34, 36 which, in turn, are connected to adjacent portions of a front wall member 38 and a back wall member 40. Adjacent top edges of the side wall members 34, 36, the front wall members 38, and back wall member 40 are all interconnected to adjacent portions of a top wall member 42.

Further, the main support housing 20 includes an intermediate wall member 44 to provide support to various components as will be explained and acts to enclose and secure a pair of spaced battery members 281 and a coin receiver tray member 261 enclosed below the intermediate wall member 44.

The front wall member 38 is provided with a coin dispenser opening 46 and a product dispensing opening 48. The product dispensing opening 48 permits an operator of the lollipop dispenser apparatus 12 to receive a dispensed lollipop member 14 therefrom.

Figure 2:
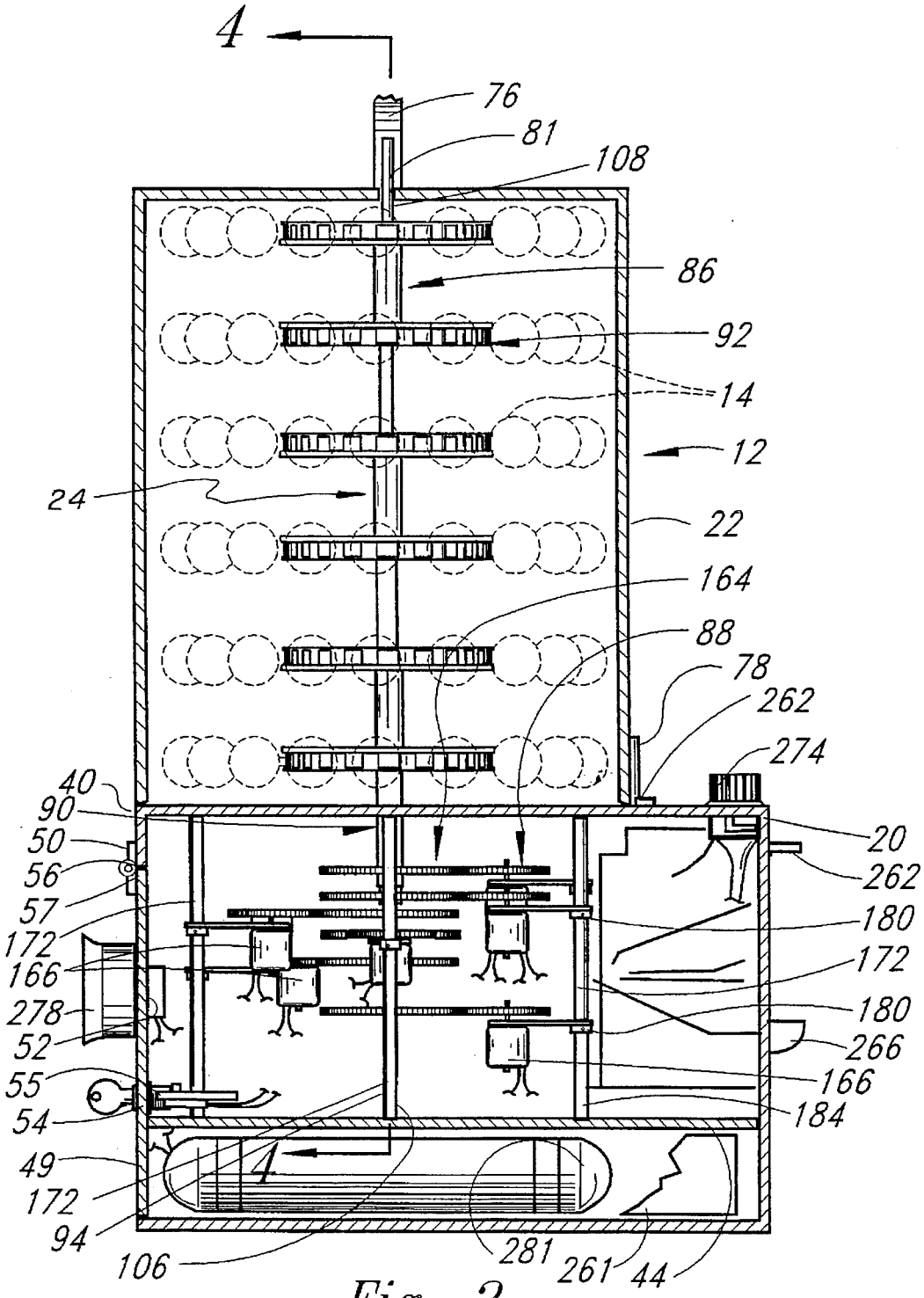
FIG. 2 is an enlarged sectional view taken along line 2—2 in FIG.

As noted in FIG. 2, the back wall member 40 is provided with an access door member 49 connected through a hinge member 50 to a top support edge 56.

The access door member 49 is provided with 1) a siren support opening 52; 2) a key lock opening 54 operable to receive a key lock member 55 therein; and 3) a upper support edge 57 to which the hinge member 50 has been attached.

The access door member 49 can be secured in the locked condition by the key lock member 55.

The access door member 49 provides access to a coin receiver tray member 261 and battery members 281.

The top wall member 42 has 1) a central shaft opening 58; 2) a product dispensing opening 60; 3) product deflector blocks 61 about inner peripheral edges of the product dispenser opening 60; 4) a selector switch opening 62; 5) indicator light opening 64, 66; 6) a dispenser button opening 68; and 7) a plurality of spaced lock lug openings 70.

The intermediate wall member 44 is provided with a support shaft hole 45.

As best noted in FIG. 1, the dispenser housing assembly 22 is of octangular shape having 1) a top wall section 72; 2) a plurality of side wall sections 74 connected to the outer periphery edges of the top wall section 72; 3) an advertising display member 76 secured to a top surface of the top wall section 72; and 4) a plurality of spaced cylindrical anchor lug members 78 secured to lower surfaces of the side wall sections 74 and mounted through the lock lug openings 70 in the top wall member 42 of the main support housing assembly 20.

The anchor lug members 78 are adapted to be connected to a locking member (not shown) so the dispenser housing assembly 22 can be anchored to the main support housing assembly 20 but selectively removed therefrom for the addition of the lollipop members 14 for subsequent display and sale thereof.

The top wall section 72 is provided with a shaft opening 81 to receive a primary support shaft 94 therethrough as will be explained.

Each side wall section 74 has a lower edge portion 80 to be mounted against the top wall member 42 of the main support housing 20.

A forward one of the side wall sections 74 is provided with a plurality, namely six, spaced vertically aligned selector indicia 47 numbered 1 to 6 for reasons to be noted.

The advertising display member 76 is provided with advertising indicia 84 to achieve an attractive and consumer friendly product display assembly.

As noted in FIG. 2, the product support and dispensing assembly 24 includes a product support and display assembly 86 mounted within the dispenser housing assembly 22 and operably inteconnected to a product dispensing assembly 88 which is mounted within the main support housing assembly 20.

Figure 4:
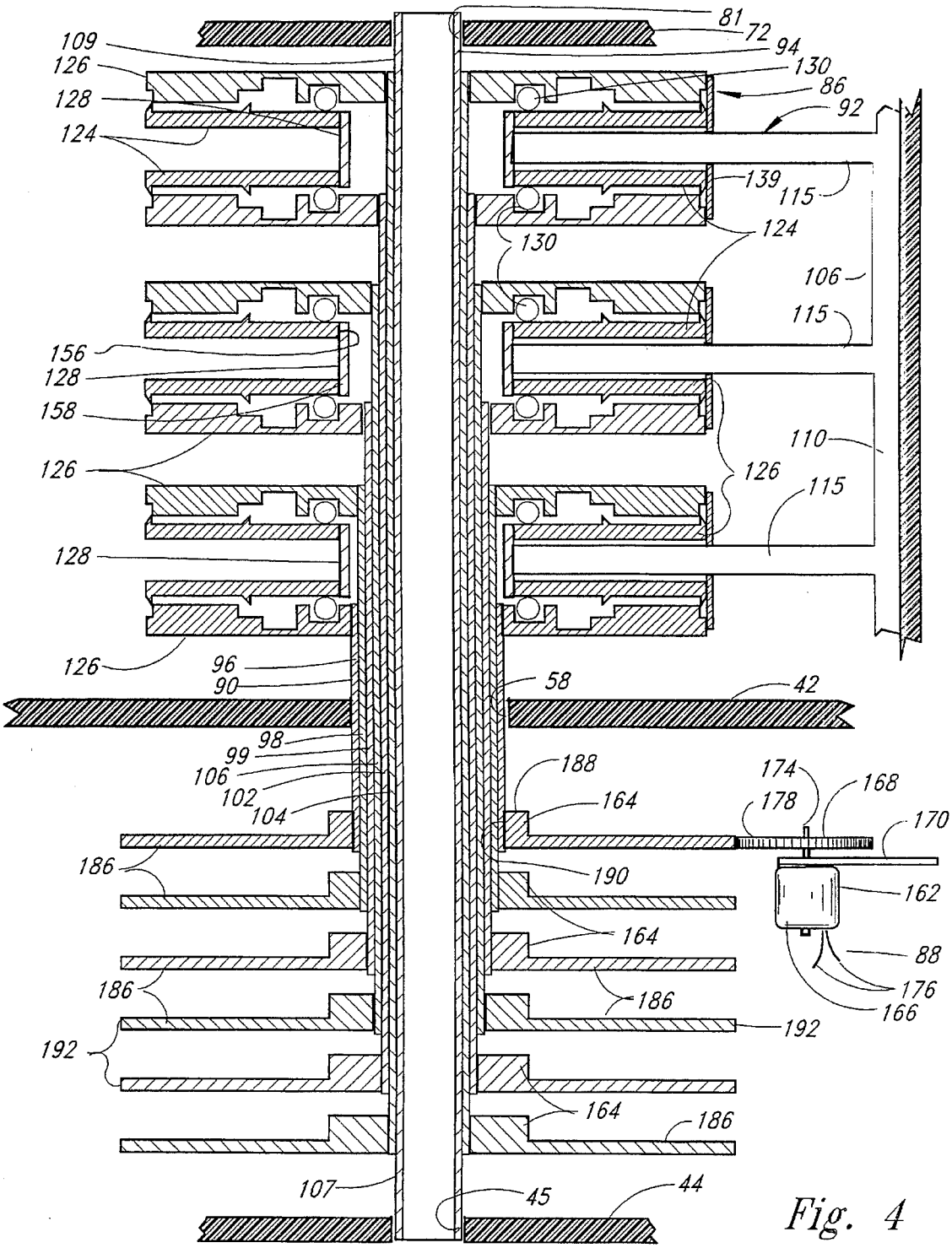
FIG. 4 is an enlarged fragmentary sectional view taken along line 4–4 in FIG.

As best shown in FIG. 4, the product support and display assembly 86 includes a support shaft assembly 90 connected to a product support and anchor assembly 92.

The support shaft assembly 90 includes a plurality of independently rotatable telescoping shaft members. More specifically, the support shaft assembly 90 includes a primary support shaft 94 having independently rotatable telescoping shafts mounted thereabout being a first dispensing shaft member 96, a second dispensing shaft member 98, a third dispensing shaft member 99, a fourth dispensing shaft member 100, a fifth dispensing shaft member 102, and a sixth dispensing shaft member 104.

Each respective dispensing shaft member 96, 98, 99, 100, 102, 104 will be associated with a portion of the product dispensing assembly 88 as will be explained in detail.

The primary support shaft 94 has a lower end section 107 mounted within the support shaft hole 45 in the intermediate wall member 44 and an upper end section 109 mounted within the shaft opening 81 in the top wall section 72 of the dispenser housing assembly 22.

The product support and anchor assembly 92 includes 1) a stationary anchor assembly 106 interconnected to a respective product support assembly 108. The stationary anchor assembly 106 includes a main anchor member 110 connected to a product deflector member 112.

As shown in FIG. 4, the main anchor member 110 is provided with a support body section 114 with an upper end portion 116 anchored to an inner surface of the top wall section 72 of the dispenser housing assembly 22 and a lower end section 118 secured to an outer surface of the top wall member 42 of the main support housing assembly 20. A plurality of support arms 115 extend outwardly from the support body section 114 for reasons to be noted.

Figure 3:
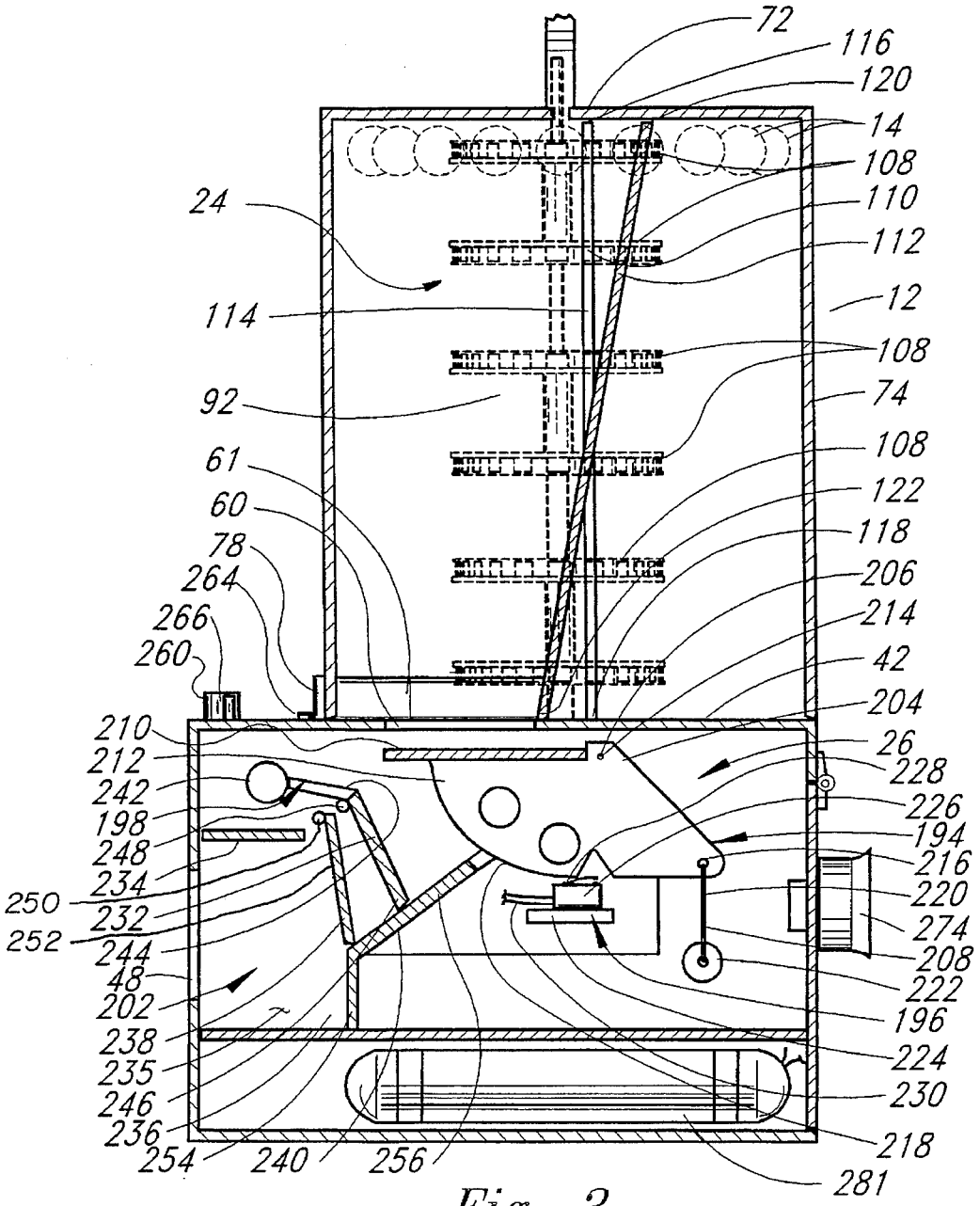
FIG. 3 is an enlarged sectional view taken along line 3—3 in FIG.

As noted in FIG. 3, the product deflector member 112 has an upper connector portion 120 connected to an inner surface of the top wall section 72 of the dispenser housing assembly 22 and a lower connector portion 122 is connected to a top surface of the top wall member 42 of the main support housing assembly 20.

A lower end of the product deflector member 112 is placed adjacent an inner edge of the product dispensing opening 60 to direct a dispensed lollipop member 14 under gravity into an interior of the main support housing assembly 20 in a manner to be described.

As noted in FIG. 4, the product support assembly 108 includes six units thereof, each having 1) a stationary support member 124 of cylindrical plate construction; 2) a rotatable support member 126 of cylindrical plate construction mounted adjacent in a cooperating working relationship with the stationary support member 124; 3) a connector cylinder member 128 secured to adjacent ones of the stationary support members 124 to hold against rotation; and 4) a plurality of bearing members 130 mounted on the stationary support members 124 and in contact with a portion of the rotatable support member 126 to lessen friction losses during relative rotation as will be explained.

Figure 5:
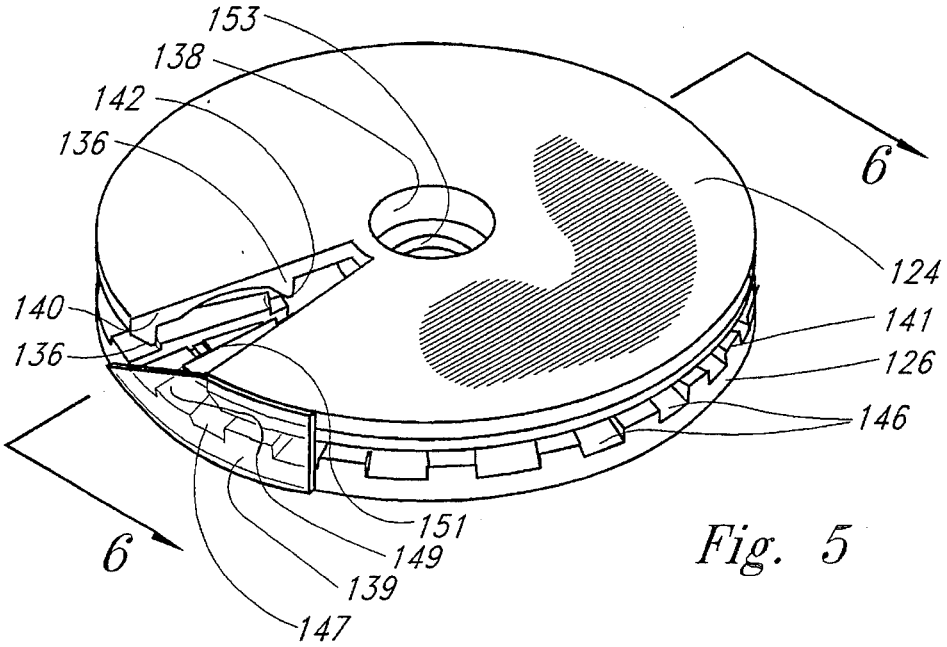
FIG. 5 is a perspective view of a product support and anchor assembly operable to receive and support lollipop members thereon.

As noted in FIG. 5, each stationary support member 124 has 1) a cylindrical plate member 132 having a support surface 134; 2) a pair of spaced circular product contact ridges 136; 3) a central shaft opening 138; 4) a dispenser cut-out 140 of V-shape; and 5) a product deflector member 139 is secured to an outer edge of the cylindrical plate member 1432 adjacent the dispenser cut-out 140.

Each product contact ridge 136 being of a generally circular shape having an outer contact point 142 is operable to engage the support stick 18 of the supported lollipop member 14 to reduce friction therewith and thus increase the life of the battery members 281.

As noted in FIG. 5, the product deflector member 139 is of an arcuate shape having a main body 147 integral with a tapered end section 149. The product deflector member 139 acts as a shield to prevent mounting of a support stick 18 of the lollipop members 14 in certain holes in each rotatable support member 126 for reasons to be noted.

The tapered end section 149 has an inclined stick contact surface 151 extended transversely of the dispenser cut-out 140 operable to contact and lift a support stick 18 from the adjacent rotatable support member 126 in an manner to be explained.

Figure 6:
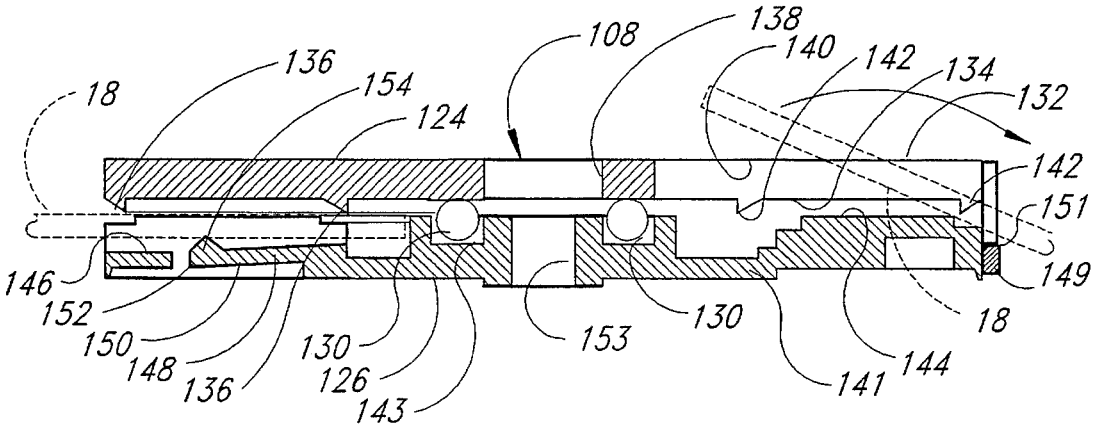
FIG. 6 is an enlarged sectional view taken along line 6—6 in FIG. 5.

As best shown in FIG. 6, each rotatable support member 126 is provided with a cylindrical dispensing plate member 141 having 1) a cylindrical bearing support channel 143; 2) an inner surface 144; 3) a plurality of spaced product containment slots 146 extended radially from a central axis; and 4) a product contact and bias member 148 mounted within a respective one of the numerous product containment slots 146.

The circular bearing support channel 143 is of a U-shape in transverse cross section and operable to receive and retain the bearing members 130 therein which are operable to contact the support surface 134 of the stationary support member 124.

The product contact and bias member 148 has a support section 150 integral with a product contact section 152. Each support section 150 is formed as a part of the cylindrical dispensing plate member 141 and located within a respective product containment slot 146.

The product contact section 152 has an outer pointed or tapered portion 154 to engage and apply pressure on a portion of the support stick 18 of a respective lollipop member 14 to assist in holding in a clamped, supported, horizontal position.

As shown in FIG. 4, each connector cylinder member 128 has an upper connector section 156 and a lower connector section 158 which are mounted within and secured to areas adjacent the central shaft openings 138 in the cylindrical plate member 132 of adjacent ones of the stationary support membes 124 to hold stationary for reasons to be explained.

One of the support arms 115 is connected to a portion of an outer surface of adjacent connector cylinder members 128 to support and prevent rotation of the adjacent stationary support members 124 (FIG. 4).

It is to be noted that each pair of the stationary support members 124 and rotatable support members 126 can be operable in an inverted position which allows a single one of the connector cylinder members 128 to be connected to adjacent ones of the stationary support members 124. This results in needing only three support arms 115 connected to the support body section 114 of the stationary anchor assembly 106 which results in cost and space saving features.

As noted in FIG. 4, the product dispensing assembly 88 includes a plurality of motor drive assemblies 162, each connected to a respective gear drive assembly 164 which, in turn, is associated with respective ones of the dispensing shaft members 96, 98, 99, 100, 102, 104 of the support shaft assembly 90.

Each one of the six (6) motor drive assemblies 162 includes 1) a drive motor member 166; 2) a drive gear member 168 connected to the drive motor member 166; 3) a motor support member 170 connected to the drive motor member 166; and 4) spaced vertical motor support shafts 172.

Each drive motor member 166 includes a power rotatable output shaft 174 secured to drive gear member 168 and electrical input wires 176 are connected to the drive motor member 166.

Each drive gear member 168 has outer drive teeth sections 178 engagable with a respective one of the drive gear assemblies 164 as will be noted.

On referring to FIG. 2, each motor support shaft 172 has 1) anchor collars 180 connected to a respective one of the motor support members 170; 2) an upper anchor section 182 connected to a lower inner surface of the top wall member 42 of the main support housing assembly 20; and 3) a lower anchor section 184 secured to an upper adjacent surface of a top surface of the intermediate wall member 44.

A plurality of the motor support shafts 172 can be utilized to support the drive motor members 166 in a spaced relationship about the motor drive assemblies 162.

As shown in FIG. 4, each gear drive assembly 164, there being a plurality, namely six thereof, is associated with a respective one of the drive motor members 166 and includes a driven gear member 186. Each driven gear member 186 is provided with a central support hub 188 having a central shaft connector opening 190 therein and outer peripheral driven tooth members 192.

Each of the support hubs 188 has a respective one of the dispensing shaft members 96, 98, 99, 100, 102, 104 secured thereto for conjoint rotation therewith.

Therefore, when a respective drive motor member 166 is energized, it will rotate the drive gear member 168 with its outer drive teeth sections 178 engagable with the outer driven tooth members 192 to achieve rotation of the rotatable support member 126 of the product support assembly 108.

The product accounting and control assembly 26 includes 1) a product trip lever assembly 194 to receive a dispensed lollipop member 14 thereagainst; 2) a product actuator switch assembly 196 operably associated with the product trip lever assembly 194; 3) a dispenser control assembly 198 to achieve speed control of the lollipop member 14 being dispensed; 4) a dispenser director housing assembly 202 to receive the dispensed lollipop member 14 therein for access by the user through the product dispensing opening 48 in the front wall member 38 of the main support housing assembly 20.

As best shown in FIG. 3, the product trip lever assembly 194 includes a trip lever member 204 pivotally mounted on a support shaft 206 and a counterbalance member 208 connected to an outer portion of the trip lever member 204.

As best shown in FIG. 3, the product trip lever assembly 194 includes a trip lever member 204 pivotally mounted on a support shaft 206 and a counterbalance member 208 connected to an outer portion of the trip lever member 204.

The trip lever member 204 includes a product contact plate 210 integral with a support body member 212. The product contact plate 210 is normally held in a horizontal position through use of the counterbalance member 208, The product contact plate 210 has an upper contact surface which is positioned below and extends across the product dispensing opening 60 in the top wall member 42.

The support body member 212 is provided with a shaft hole 214 and a counterbalance hole 216. The support shaft member 206 is mounted through the shaft hole 214 and connected to adjacent portions of the main support housing assembly 20.

The counterbalance member 208 includes a support rod member 220 having one end mounted in the counterbalance hole 216 and an opposite end connected to weight members 222. The weight members 222 can be a plurality of washer members so that the counterbalance member 208 can be adjusted to place the top surface of the product contact plate 210 in a horizontal inactive position as noted in FIG. 3.

The product actuator switch assembly 196 includes a switch support member 224 which is anchored for non-movement and having a micro switch member 226 mounted thereon. The micro switch member 226 includes a trip lever 228 to supply or cease electrical power through electrical power wires 230.

The trip lever 228 is operable to be engaged by a switch actuator surface 218 on the trip lever member 204 when pivoted counterclockwise as noted in FIG. 9. This opens contacts in the micro switch member 226 and ceases all power supply from the battery members 281 after pivotal movement of the trip lever member 204.

The dispenser control assembly 198 includes an access preventor door assembly 232 and a dispenser director housing assembly 202.

The access preventor door assembly 232 includes 1) a counterweight section 242 connected to a support section 244; 2) a product contact section 246; and 3) a support shaft member 248.

The product contact section 246 is operable to be engaged by a dispensed lollipop member 14 for clockwise pivotal movement about the support shaft member 248 as noted in FIG. 3. The counterweight section 242 is operable to provide a resistance to pivotal movment to slow down the speed of the dispensed lollipop member 14.

The main purpose of the access preventor door assembly 232 is to prevent access to internal parts of the lollipop dispenser apparatus 12 by small hands of children.

The dispenser director housing assembly 202 includes 1) an enclosure compartment 235; 2) an access control member 238; and 3) a slide wall member 240.

The dispenser enclosure compartment 235 includes a top wall member 234 and side wall members 236 providing an enclosed area to receive the dispensed lollipop member 14 therein.

As noted in FIG. 3, the access control member 238 includes an access shaft member 250 having to a contact flap member 252 connected thereto. The contact flap member 252 acts as a one-way door so that a person receiving a dispensed lollipop member 14 cannot gain further access to an interior of the main support housing assembly 20.

The slide wall member 240 includes a support section 254 integral with an inclined section 256. The support section 254 is secured to an adjacent upper surface of the intermediate wall member 44. The inclined section 256 inclines upwardly towards the trip lever member 204.

An upper inner surface of the inclined section 256 is operable to receive a lower surface of the product contact plate 210 of the trip lever member 204 thereagainst to stop downward pivotal movement.

The coin acceptor, selector, and dispenser assembly 28 includes 1) a coin acceptor assembly 258; 2) a dispenser selector switch 260; 3) a coin acceptor light member 262; 4) a product dispensing light member 264; and 5) a dispenser switch or button member 266.

The coin acceptor assembly 258, as noted in FIG. 1, is substantially a conventional structure known in the prior art and can be programmed to accept a single coin, such as a quarter, or a multiple combination thereof, such as two dimes and a nickel or five nickels. The placing of a coin member or coin members therein can be counted and monitored through use of micro switch trip levers or other such means known in the prior art.

As shown in FIG. 1, the coin acceptor assembly 258 is provided with a main support plate 251 having thereon 1) a coin deposit slot 253; 2) a coin reject button 255; 3) a coin return slot 257; 4) a coin return cup 259 to receive a rejected coin therein; and 5) a coin receiver switch 268 (FIG. 7) to be activated by placement of a coin member through the coin deposit slot 253.

Any coins passing through the coin deposit slot 253 would proceed under the force of gravity until collected within a coin receiver tray member 261.

The dispenser selector switch 260 is mounted within the selector switch opening 62 in the top wall member 42 of the main support housing assembly 20. The dispenser selector switch 260 is provided with a central control knob 274 having a selector line thereon which can be aligned with selected ones of adjacent product selector indicia 272 on the top wall member 42.

The coin acceptor light member 262 and the product dispensing light member 264 would be mounted within respective ones of the indicator light openings 64, 66 in the top wall member 42 of the main support housing assembly 20.

The electrical control circuit 30 includes a tilt siren assembly 278 and a pair of battery members 281 connected to an electrical circuit 279.

The tilt siren assembly 278 is provided with a tilt switch member 280 connected to a siren member 282 and the electrical circuit 279 (FIG. 7) by electric wires 284. The tilt siren assembly 278 can be of a conventional nature which is normally actuated by vibration to the lollipop dispenser apparatus 12 which can be a weight lever switch, a mercury switch, or the like which is known in the prior art. Subject vibration would simultaneously energize the tilt siren assembly 278.

The battery members 281 are connected into the system so that there is no power drain thereon unless the system is being energized by the dropping of a coin member into the coin acceptor assembly 258. The system is de-energized on dispensing of a lollipop member 14 through the product trip lever assembly 194.

Figure 7:
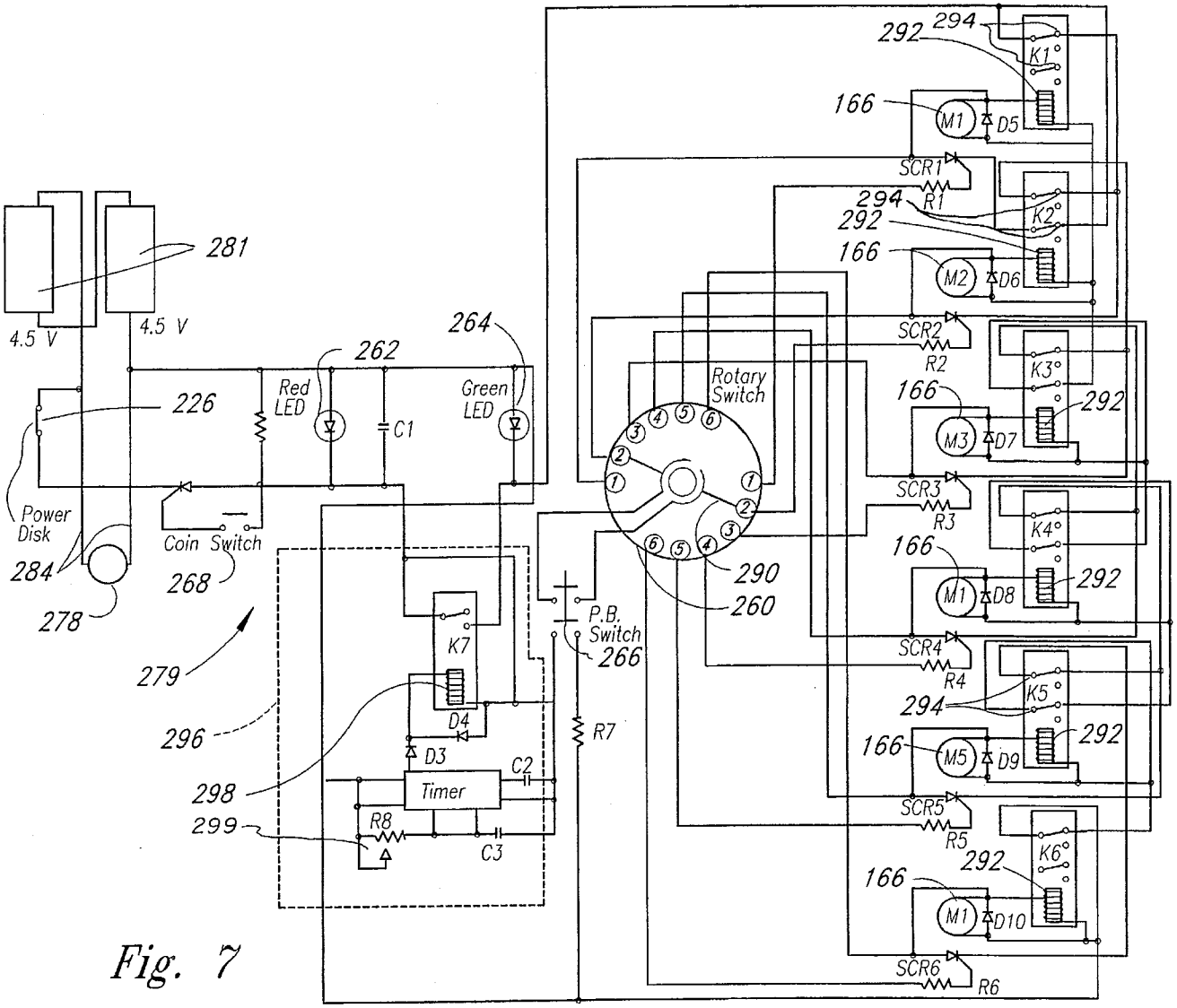
FIG. 7 is an electrical control circuit schematic.

On referring to FIG. 7 to the electrical circuit 279, it is to be noted that this is a conventionally known circuit diagram readily understood by ones skilled in the art and, therefore, detailed explanation of each element thereof is not deemed necessary.

The following is an "Electronic Component Table" setting forth the identification of all the elements therein.

S1-Lever micro switch with roller, SPDT, operating force: 5 grams. Rating: 5 amps at 250 vac. Radio Shack cat.#275-017
S2-Coinco standard coin actuated switch
S3-Rotary 2 pole-6 position, non-shorting 0.3 amp at 125 vac. Radio Shack cat.#275-1386
S4-DPDT momentary push button
T1-Transformer: input 120 vac 60 hz 8 w, output 9 vdc 300 ma Radio Shack cat.#273-1455A
SCR1 to 7-Silicon Controlled Rectifier, 6 amp., 200 volt Radio Shack cat.#276-1067, total 7
D1-Red flashing LED-Radio Shack cat.#276-036
D2-Green flashing LED-Radio Shack cat.#276-030
D3 to 4-1N914 Diode, total 2
D5 to 10-1N4004 Diode, total 6
R1 to 6+9-Resistor 100 ohm, total 7
R7 to 10K-Resistor, total 4
R8-1 meg variable Resistor
C1-Capacitor 0.1 uf
C2-Capacitor 0.01 uf
C3-Capacitor 10 uf-electrolytic
K1 to 6-Relay: Aromat HB25, 5 vdc, DPDT, total 6
K7-Relay: 5 vdc, SPDT, Radio Shack cat.#275-243
M1 to 6-3 vdc electric motor with gear drive, total 6
Integrated Circuit-555 Timer We will describe the basic functional operation of the electrical circuit 279 so that it can be readily understood during the operation thereof.

First, the electrical circuit 279 is supplied electrical power from the battery members 281 which are trained through the normally closed micro switch member 226 of the product actuator switch assembly 196.

The micro switch member 226 would be opened by the actual dispensing of a lollipop member 14. The opening of the normally closed micro switch member 226 would then cease all power supply to the electrical system except power is continuously supplied to the tilt siren assembly 278.

The tilt siren assembly 278 will not drain power until energized when movement or vibration is detected through use of a mercury switch or the like.

A first step of operation would be the insertion of a coin member or members by a user which would then trip the coin receiver switch 268 which would cause a momentary closing. Due to use of a silicon control rectifier 288 (a known solid state relay), the electrical circuit 279 will be completed to the coin acceptor light member 262.

A second step would be that the user would rotate the control knob 274 of the dispenser selector switch 260 to choose a desired product or lollipop member 14 to be dispensed as indicated by the product selector indicia 272.

The dispenser selector switch 260 would then align transversely as noted by an electrical line 290 which would then complete the circuit to one of the six flavor selections.

The drive motor members 166 and motor relay members 292 are in parallel and actuated only when the momentary dispenser switch member 266 is depressed. Concurrently, the product dispensing light member 264 is in parallel and starts flashing as a Green LED.

Each of the motor relay members 292 have a pair of relay contacts 294.

During operation, the dual relay contacts 294 operate to disconnect power supply to the other five (5) non-selected drive motor members 166 so that only one thereof will rotate to dispense a lollipop member 14 therefrom.

A third step is for the user to push the dispenser button member 266 to cause a momentary power supply through the electrical line 290 to the selected one of the drive motor members 166 and the closed motor relay members 292 so that all other drive motor members 166 except the selected one will not operate.

Concurrently, power is supplied to an adjustable timing circuit 296 which pulls in a relay member 298 to activate controlled timing thereof. The timing circuit 296 is of a well known integrated circuit with a variable resister 299 which is adjustable so that the respective drive motor member 166 will rotate only for a certain period of time (such as 5–10 seconds) and power is then ceased thereto. This is important when a certain horizontal layer of lollipop members 14 have been completely dispensed as this prevents the initially powered drive motor member 166 from continuously rotating with subsequent power drain on the battery members 281.

If a lollipop member 14 has not been dispensed, then the product dispensing light member 264 will cease to be energized or blinking. The user would notice the lollipop member 14 has not been dispensed and actuate the dispenser selector switch 260 to a different layer containing lollipop members 14 thereon.

On selecting a new layer having lollipop members 14 supported thereon, the user would again actuate the dispenser button member 266. This would then energize the drive motor member 166 to rotate the chosen rotatable support member 126 for rotation for a time period as pre-set in the timing circuit 296.

The rotating lollipop member 14 may, in certain circumstances, cause its support stick 18 to contact the contact surface 151 of the product deflector member 139. This lifts the support stick 18 out of the product containment slot 146 (if it sticks therein) and the weight of the food product 16 causes the lollipop member 14 to fall. Then, the lollipop member 14 would be dispensed under the force of gravity through the dispenser cut-out 140 in the respective stationary support member 124. The product deflector member 139 mainly operates to prevent wrongful loading of lollipop members 14 in the product containment slots 146 in the respective rotatable support members 126 as will be noted.

The dispensed lollipop member 14 would then impact the product contact plate 210 of the trip lever member 204 for pivotal movement downwardly as clearly shown in FIG. 9. This would activate the micro switch member 226 which, due to the silicon control rectifier 288, acts similar to a relay and would drop all power to the remaining portions of the electrical circuit 279.

The dispensed lollipop member 14 would pass through the product trip lever assembly 194 into the dispenser control assembly 198 and finally into the dispenser director housing assembly 202 whereupon it can be retrieved by the user through the product dispensing opening 60 in the front wall member 38 of the main support housing assembly 20.

The product deflector members 139 act as a shield to prevent insertion of the support sticks 18 of the lollipop members 14 into the product containment slots 146 between the dispenser cut-outs 140 and the stationary anchor assembly 106.

Without the product deflector members 139, the lollipop dispenser apparatus 12 could be loaded improperly. A rotating lollipop member 14 would impact the stationary anchor assembly 106 and possibly burn out a selected drie motor member 166.

An important feature of the lollipop dispenser apparatus 12 is the method of supporting the support sticks 18 of the lollipop members 14 at three low friction contact points being the product contact ridges 136 and the tapered portion 154 of the product contact and bias member 148 (FIG. 6).

With rotation of the rotatable support member 126, a selected one of the lollipop members 14 approaches the V-shaped dispenser cut-out 140 in the stationary support member 124.

Then, the respective clamped support stick 18 is released in an extremely controlled and precise way to cause the lollipop member 14 to fall very accurately into the product dispensing opening 60 in the top wall member 42 of the main support housing assembly 20.

This accurate dispensing is achieved by making certain that, as the support stick 18 of the lollipop member 14 being dispensed reaches the dispenser cut-out 140, the innermost end of support stick 18 is the last part to be released.

At that time, the spring pressure of the product contact and bias member 148 pushes the support stick 18 out of the dispenser cut-out 140.

It is noted that FIG. 4 has been shown in non-proportionate size relationship to more clearly depict the applicant's invention.

The lollipop dispenser apparatus of this invention has numerous unique features such as 1) being constructed of a transparent material so that the actuator mechanism and the rotating mechanisms for supporting and dispensing the lollipop members are readily visible to the user thereof; 2) being supplied by rechargeable batteries or inexpensive 9 volt radio batteries having a minimal current drain during a lollipop dispensing operation so that it can be placed in various locations without requiring the availability of a 110 volt power supply; 3) provided with an electrical circuit having indicator lights and a dispenser selector switch including means to assure that, after a coin has been accepted, the user will always receive a lollipop member therefrom; 4) provided with a tilt siren assembly having an audio siren indicating unauthorized vibration or attempted entry thereto; and 5) having an electrical control circuit so that power is not drained from the battery battery members when in an inactive or non-dispensing mode.

While the invention has been described in conjunction with preferred specific embodiments thereof, it will be understood that this description is intended to illustrate and not to limit the scope of the invention, which is defined by the following claims:

I claim:

1. A lollipop dispenser apparatus operable to hold, display, and selectively dispense lollipop members therefrom, comprising:

a) a main support housing having a dispenser housing assembly mounted thereon;

b) a product support and dispensing assembly including a product support and display assembly connected to a product dispensing assembly;

c) said product support and display assembly having a product support and anchor assembly operable to receive and support a plurality of said lollipop members;

d) a product accounting and control assembly operably connected to said product support and dispensing assembly operable to assure positive dispensing of a lollipop member;

e) an electrical control circuit connected to said product support and display assembly;

f) a coin acceptor, selector, and dispenser assembly connected to said electrical control circuit operable, on receiving an impluse signal, to engage said product support and display assembly to dispense a lollipop member from said main support housing assembly; and g) said product accounting and control assembly having a product trip lever assembly engaged by a dispensed one of the lollipop members to cease power to said impulse signal to stop a lollipop dispensing operation only after the lollipop member has been dispensed.

2. A lollipop dispenser apparatus as described in claim 1, wherein:

a) said main support housing assembly and said disperser housing assembly constructed of a rigid, transparent material whereby the unique dispensing operation of said lollipop dispenser apparatus is readily observed and entertaining to a user thereof.

3. A lollipop dispenser apparatus as described in claim 1, wherein:

a) said electrical control circuit having an electrical power source only during a lollipop member dispensing operation and, thus, saves energy.

4. A lollipop dispenser apparatus as described in claim 3, wherein:

a) said electrical power source is a rechargeable battery.

5. A lollipop dispenser apparatus as described in claim 1, wherein:

a) said product support and dispensing assembly includes a product support and display assembly having a product support assembly;

b) said product support assembly includes a support member operable to receive and support a plurality of radially extended lollipop members thereon; and c) said support member is movable in response to the impulse signal to release and dispense one of the plurality of lollipop members therefrom.

6. A lollipop dispenser apparatus as described in claim 5, wherein:

a) said product support assembly includes a plurality of said support members, all connected to a support shaft assembly, and selectively and independently rotatable on said support shaft assembly;

b) said product support and dispensing assembly includes a product dispensing assembly having a plurality of motor drive assemblies connected to respective ones of a plurality of gear drive assemblies; and c) said gear drive assemblies connected to said support shaft assembly and operable to selectively rotate one of said support members to dispense a lollipop member therefrom.

7. A lollipop dispenser apparatus as described in claim 5, wherein:

a) said support member includes a stationary support member having a rotatable support member connected to said stationary support member;

b) said rotatable support members include a product containment slot to receive a portion of a lollipop member therein; and c) said stationary support members include a product contact ridge which engages and retains the portion of the lollipop member when mounted in said product containment slot.

8. A lollipop dispenser apparatus as described in claim 7, wherein:

a) said rotatable support member includes a plurality of said product containment slots extended radially outward to receive and support respective ones of the plurality of lollipop members therein.

9. A lollipop dispenser apparatus as described in claim 7, wherein:

a) said rotatable support member includes a product bias member mounted in said product containment slot in contact with the portion of a lollipop member mounted therein;

whereby said product bias member holds the lollipop member against said product contact ridge in a firm and generally horizontal condition.

10. A lollipop dispenser apparatus as described in claim 1, wherein:

a) said coin acceptor, selector, and dispenser assembly includes a coin acceptor assembly, a dispenser selector switch, and a dispenser switch member;

b) said coin acceptor assembly operable on receiving a coin member to energize said electrical control circuit;

c) said dispenser selector switch operable to select a particular one of the lollipop members to be dispensed; and d) said dispenser switch member operable to energize said product support and display assembly and dispense a lollipop member therefrom.

11. A lollipop dispenser apparatus as described in claim 10, including:

a) a product accounting and control assembly including a product trip lever assembly pivotally connected to said main support housing assembly and a product actuator switch assembly operably connected to said product trip lever assembly;

b) said product trip lever assembly mounted transversely of a path of movement of a dispensed one of the lollipop members; and c) pivotal movement of said product trip lever assembly causes said product actuator switch assembly to open and disconnect from a power source in said electrical control circuit;

whereby said power source is not used until the coin member is deposited in said coin acceptor assembly and said power source is disconnected on dispensing a lollipop member through said product trip lever assembly.

12. A lollipop dispenser apparatus as described in claim 10, wherein:

a) said coin acceptor, selector, and dispenser assembly includes a coin acceptor light member and a product dispensing light member connected to said electrical control circuit;

b) said coin acceptor light member flashes after the coin member is inserted in said coin acceptor assembly;

c) said product dispensing light member flashes on actuation of said dispenser switch member; and d) said coin acceptor, selector, and dispenser assembly is de-energized to cease any electrical power drain on an electrical power source on dispensing a lollipop member.

13. A lollipop dispenser apparatus operable to hold, display, and selectively dispense lollipop members therefrom, comprising:

a) a main support housing assembly;

b) a product support and dispensing assembly connected to said main support housing assembly;

c) said product support and dispensing assembly includes a product support and display assembly operably connected to a product dispensing assembly;

d) said product support and display assembly including a support shaft having one end connected to said main support housing assembly and another end connected to a product support assembly;

e) said product support assembly includes a stationary support member mounted in a juxtapose relationship with a rotatable support member which is connected to said support shaft member; and f) said rotatable support member having a plurality of outwardly and radially extended product containment slots, each operable to receive and support one of the lollipop members therein in a generally horizontal plane.

14. A lollipop dispenser apparatus as described in claim 13, wherein;

a) said stationary support member having a dispenser cut-out; and b) said rotatable support member selectively rotatable to place a support stick of a lollipop member into said dispenser cut-out;

whereby subject lollipop member falls under force of gravity on being disengaged from said product support assembly.

15. A lollipop dispenser apparatus as described in claim 13, wherein:

a) said product support and display assembly includes a support shaft assembly having a plurality of said support shaft; and b) each of the plurality of said support shaft having one of said product support assembly connected to respective upper ends thereof in stacked relationship to each other;

whereby each of said rotatable support members are operable to hold a row of the lollipop members in stacked, spaced horizontal planes.

16. A lollipop dispenser apparatus as described in claim 13, wherein:

a) said product dispensing assembly includes a drive motor member connected to said main support housing assembly and a driven gear member connected to said drive motor member and said support shaft; and b) said drive motor member is selectively energized to rotate said driven gear member, said support shaft, and said rotatable support member to dispense a lollipop member from one of said product containment slots.

17. A lollipop dispenser apparatus as described in claim 13, wherein:

a) said stationary support member having a pair of spaced concentric product contact ridges to engage a support stick of the lollipop members mounted in said product containment slots with a minimum friction loss on rotation of said rotatable support member.

18. A lollipop dispenser apparatus as described in claim 13, wherein:

a) said product containment slots each having a product bias member with an outer tapered portion to engage respective ones of the support sticks of the lollipop members to achieve biased support and minimum friction loss; and b) said product support assembly includes bearing members mounted between said stationary support member and said rotatable support member for a minimum friction loss on rotation of said rotatable support member.

19. A lollipop dispenser apparatus as described in claim 13, including:

a) a coin acceptor and dispenser assembly connected to said main support housing assembly including a coin acceptor assembly, a dispenser selector switch, and a dispenser switch member;

b) a product accounting and control assembly including a product actuator switch assembly operable to open electrical contacts on dispensing of a lollipop member;

c) an electrical control circuit connecting said coin acceptor assembly, said dispenser selector switch, said dispenser switch member, and said product actuator switch assembly to a power source;

d) said coin acceptor assembly operable on receiving a coin member therein to supply electrical current from said power source to said coin acceptor and dispenser assembly and said product accounting and control assembly;

e) said dispenser selector switch is operable to select a respective horizontal row of lollipop members from which a lollipop member is to be dispensed;

f) said dispenser switch member is operable to rotate said rotatable support member to dispense a lollipop member under the force of gravity; and g) the dispensed lollipop member is operable to open said electrical contacts on said product actuator switch assembly and cease all electrical power drain on said power source.

20. A lollipop dispenser apparatus as described in claim 19, wherein:

a) said power source is a rechargeable battery without an external power source being required and no power drain except during a lollipop member dispensing operation.

21. A lollipop dispenser apparatus as described in claim 19, wherein:

a) said coin acceptor and dispenser assembly includes a coin acceptor light member and a product dispensing light member connected to said electrical control circuit;

b) said coin acceptor light member is illuminated on acceptance of the coin member in said coin acceptor assembly;

c) said product dispensing light member is illuminated on actuation of said dispenser switch member to cause rotation of said rotatable support member; and d) said product dispensing light member stays illuminated until a lollipop member is dispensed to open said product actuator switch assembly.

22. A lollipop dispenser apparatus as described in claim 21, wherein:

a) said electrical control circuit includes a timing circuit operable to rotate said rotatable support member a selected time period only if a lollipop member is not dispensed; and b) said product dispensing light member continues to be illuminated after said rotatable support member ceases to rotate to signal that the operator needs to select another horizontal row of lollipop members and again actuate said dispenser switch member;

whereby the operator is guaranteed to receive a lollipop member on insertion of a coin member if a lollipop member is available in said lollipop dispenser apparatus.

23. A lollipop dispenser apparatus operable to hold, display, and selectively dispense lollipop members therefrom, comprising:

a) a main support housing assembly;

b) a product support and display assembly connected to a product dispensing assembly, both connected to said main support housing assembly;

c) said product support and display assembly includes a support shaft assembly connected to a product support assembly;

d) said product support assembly operable to receive and support respective support sticks of a plurality of radially extended lollipop members;

e) said product dispensing assembly connected to said support shaft assembly and selectively operable to rotate said product support assembly to dispense one of the lollipop members under force of gravity;

f) a product accounting and control assembly including a product trip lever assembly operably connected to a product actuator switch assembly;

g) said product trip lever assembly pivotally connected to said main support housing assembly and having a trip lever member mounted transversely of a path of travel of released ones of the lollipop members;

h) an electrical control circuit having a power source operably connected to said product dispensing assembly and said product actuator switch assembly;

i) an acceptor assembly being actuated to energize a power supply from said power source; and j) on dispensing a lollipop member from said product support assembly, the lollipop member hits and pivots said trip lever member to open said product actuator switch assembly to cease said power supply from said power source;

whereby no power is being drained from said power source except during a lollipop dispensing operation.

24. A lollipop dispenser apparatus as described in claim 23, wherein:

a) said support shaft assembly includes a plurality of telescoping shaft members, each having an upper end connected to one of said product support assemblies and a lower end to said product dispensing assembly; and b) said product dispensing assembly includes a drive motor member connected to a driven gear member which, in turn, are connected to respective ones of said telescoping shaft members;

whereby each of said product support assemblies are selectively and independently rotatable to dispense a selected lollipop member therefrom.

25. A lollipop dispenser apparatus as described in claim 23, including:

a) a dispenser housing assembly mounted on said main support housing assembly and enclosing said product support assembly; and b) said main support housing assembly and said dispenser housing assembly constructed of a transparent material;

whereby the unique dispensing operation of said lollipop dispenser apparatus is readily observed and entertaining to a user thereof.

26. A dispenser apparatus operable to hold, display, and selectively dispense articles therefrom, comprising:

a) a main support housing assembly;

b) a product support and dispensing assembly connected to said main support housing assembly;

c) said product support and dispensing assembly includes a product support and display assembly operably connected to a product dispensing assembly;

d) said product support and display assembly including a support member having one end connected to said main support housing assembly and another end connected to a product support assembly;

e) said product support assembly includes a stationary support member operably connected to a rotatable support member which is connected to said support member; and f) said rotatable support member having a plurality of containment slots, each operable to receive and support one of the articles therein.

* * * * *